US005619073A

United States Patent [19]

Posey et al.

[11] Patent Number: 5,619,073

[45] Date of Patent: Apr. 8, 1997

[54] PROPELLANT GRAINS AND PROCESS FOR THE PRODUCTION THEREOF

[75] Inventors: B. Kelley Posey, St. Louis, Mo.; David M. Hurley, Alton, Ill.; R. David Seybert, Edwardsville, Ill.; M. Russel Phinney, Collinsville, Ill.

[73] Assignee: Propellex Corporation, Edwardsville, Ill.

[21] Appl. No.: 515,386

[22] Filed: Aug. 15, 1995

[51] Int. Cl.[6] ..... C06B 21/00; F42B 3/00

[52] U.S. Cl. ..... 264/3.3; 264/3.1; 102/288; 102/289; 86/20.12; 86/21

[58] Field of Search ..... 264/3.2, 3.3, 3.1; 86/20.12, 21; 102/288, 289

[56] References Cited

U.S. PATENT DOCUMENTS

| | | | |
|---|---|---|---|
| 3,396,215 | 8/1968 | Hittinger | 264/3.1 |
| 4,050,347 | 9/1977 | Adelman et al. | 86/20 R |
| 4,585,600 | 4/1986 | Rollyson et al. | 264/3.3 |
| 5,349,892 | 9/1994 | Taylor et al. | 86/21 |

*Primary Examiner*—Peter A. Nelson
*Attorney, Agent, or Firm*—Kalish & Gilster

[57] ABSTRACT

A batch process produces unitary grains of propellant material. A constituent mixture of the material is prepared by mixing constituents while heating to at least a predetermined pouring temperature within a permissible temperature range. The constituent mixture is poured into a mold, while vibrating it to avoid voids or interfaces within the material, to cast a block of propellant. The cast block is cured for a predetermined period resulting in a cured, cast block of semirigid yet plasticly deformable material. A hydraulic press with a ram carrying a tubular cutting die is positioned, as by transferring the mold without its bottom to the press bed, for permitting grains to be cut by movement of the press ram by forcing the cutting die into the cast block to cut from the block a grain of the propellant material, then extracting the grain for further use. The cutting cycle is repeated until the cast block has yielded a satisfactory number of grains. Preferably, inert dowel plugs are inserted into each cut cavity after the grain is extracted to maintain dimensional stability of the block for successive cutting cycles. A propellant grain produced by such process is of unexpectedly high quality.

15 Claims, 2 Drawing Sheets

PROPELLANT GRAINS AND PROCESS FOR THE PRODUCTION THEREOF

BACKGROUND OF THE INVENTION

The invention relates to so-called propellant grains, namely monolithic, unitary propellant structures of a non-granular nature, and more particularly, to a process for producing such grains.

As used herein, the terms grain or grains accordingly refer to such unitary structures or what may be termed macro-structures or unitary grains rather to granular materials as typically of powders and granular propellants in the form of minute particles.

Presently, unitary grains of a propellant or other ignitable material or mixture are prepared individually in molds of various sizes and shapes. In the molding of a propellant or other ignitable material or mixture, it is known that the problem of interfaces and voids in the resulting grain acutely affects the burn pattern of the grain as well as its ability to withstand limited amounts shearing and stress.

Because present industry practice relies typically upon molding each grain individually, there is a great deal of labor involved. Moreover, present industry practice also contributes to both the presence and frequency of interfaces and voids in each grain and also results in a low degree of uniformity from grain-to-grain and a considerable amount of waste.

Molding of unitary cartridge charges dates to at least as early as Lamm U.S. Pat. No. 435,842 issued in 1890 which proposed molding cylindrical charges of what then was termed explosive material but was in probability a fusible propellant composition. A more recent example of the patented art is U.S. Pat. No. 3,353,438 issued to Scanlon and Quinlan for a device for molding propellant cylinders for use in caseless ammunition in which a casing received propellant composition and cylindrical member was insertable into the cavity receiving the composition for forming a bore thereof. The latter method is but one known method of tube casting of grains. Tube casting has the known difficulty of permitting voids or more subtle discontinuities to be introduced into the limited amount of composition placed in the tubular mold cavity.

Similarly it has been known to use split molds for casting of grains. Split molds also may permit voids or discontinuities but also may leave mold flash or sprue remnants. A grain formed by such mold casting technique may accordingly require objectionable, time-consuming lathe turning under precise, care-intensive control regimes to remove unwanted projections or to achieve a final cylindrical dimension. Moreover, such casting methodologies offer only limited ultimate grain geometries or surface topologies.

Stacking of layers of propellant is also well known, as taught by Maxim U.S. Pat. No. 778,788, but stacking of propellant or combustible mixtures, with attendant disadvantages and limitations, is not suitable to certain propellant devices in which is it is desired to have the advantage of using grains of unitary nature.

Although the term propellant grain is used in the present disclosure, it will be understood to comprehend ignitable or combustible grains not necessarily used as a propellant per se but having other uses when the grain is ignited such as, without limitation, for controlled release of substances or as a carrier for substances including gaseous propellant component or reaction mixture discharge. E.g., such a grain may serve a gas generator function.

SUMMARY OF THE INVENTION

It is believed that the invention substantially overcomes the foregoing problems and limitations of the above-mentioned disclosures and represents a major advance in the art of propellant manufacture.

Accordingly, among the several advantages, objects or inventive features of the present development may be noted the provision of an improved propellant grain having neglible voids or interfaces within it; which is relatively facilely and reliably formed; and which is capable of meeting precise product tolerances and specifications with a high degree of uniformity and precise quality from grain-to-grain so as to achieve rigorous quality control standards; and the provision of a novel and highly effective as well as highly efficient process of manufacturing such grains without labor-intensive steps heretofore required, the process permitting batch production of grains with labor saving procedure achieving high throughput and wherein there is grain-to-grain uniformity within each batch; and which process may not only be repeated each time with precision and uniformity but also involves less wastage of material; which avoids formation of voids and discontinuities; which avoids mold flash or sprue remnants; which obviates objectionable, time-consuming lathe turning or other post-formation grain machining; which achieves precise grain dimensions; and which conduces to grain formation with myriad possible grain geometries and surface topologies.

Briefly, a process for the production of a batch of unitary grains of propellant or other ignitable material, comprises or essentially comprises preparing a constituent mixture of the material by mixing constituents of the material while heating the mixture to at least a predetermined pouring temperature within a permissible temperature range. The process next entails pouring the constituent mixture into a topless mold of selected configuration, the mold having non-stick internal surfaces and having a removable bottom. The so-poured constituent mixture is then cured by permitted it to remain undisturbed in the mold for a predetermined period of time resulting in a cured, cast block of semirigid yet plasticly deformable propellant material from which grains can be cut. To assist in minimizing or avoiding interfaces and voids which may be formed, the mold is placed on a vibrating apparatus during filling and/or curing. Once the cast block is cured, the bottom of the mold is removed and the remaining portion of the mold, namely its walls, may be surrounded by a support frame or other wall support apparatus placed over the exterior of the mold walls to prevent the mold walls from flexing during the cutting process. The mold portion containing the cast block and, if used, the walled support apparatus are placed in die-cutting relation to apparatus capable of executing cutting die strokes, viz., under an hydraulic press ram equipped with one or more thin-walled tubular cutting dies, in supported relation upon a wood chip-board cutting block. The press is then operated through a die-cutting cycle in which the die is forced into the cured block and then retracted. When forced by the ram into the cured mixture each die cutter cuts a single grain at a time and extracts it. A plurality of such dies may be carried by the ram for cutting a plurality of grains at a time. Each thin-walled cutting die is of selected configuration such that, when removed from the cured mixture, it withdraws the cured block a grain of selected cross-section corresponding to that of the die.

Preferably, as each grain is withdrawn, the press or other auxiliary means is used to place a plug, viz., a dowel of wood, polyurethane or other suitably inert, non-reactive material, within the resultant bore or aperture, namely a grain-removal void, remaining after the grain is withdrawn from the cured block, the dowel having dimensions closely conforming to the bore such that each so-inserted dowel maintains the dimensional stability of the block.

A propellant grain produced by such process is of unexpectedly high quality. The batch process is accordingly less labor intensive than molding of individual grains. Resulting grains made according to the process are of a high uniform quality having a minimal number of interfaces and voids or other discontinuities and thus minimize the amount of waste.

Other advantages invention will be apparent or are pointed out in the following detailed description and attached drawings.

DESCRIPTIVE OF PRACTICAL EMBODIMENTS

Figure 1:
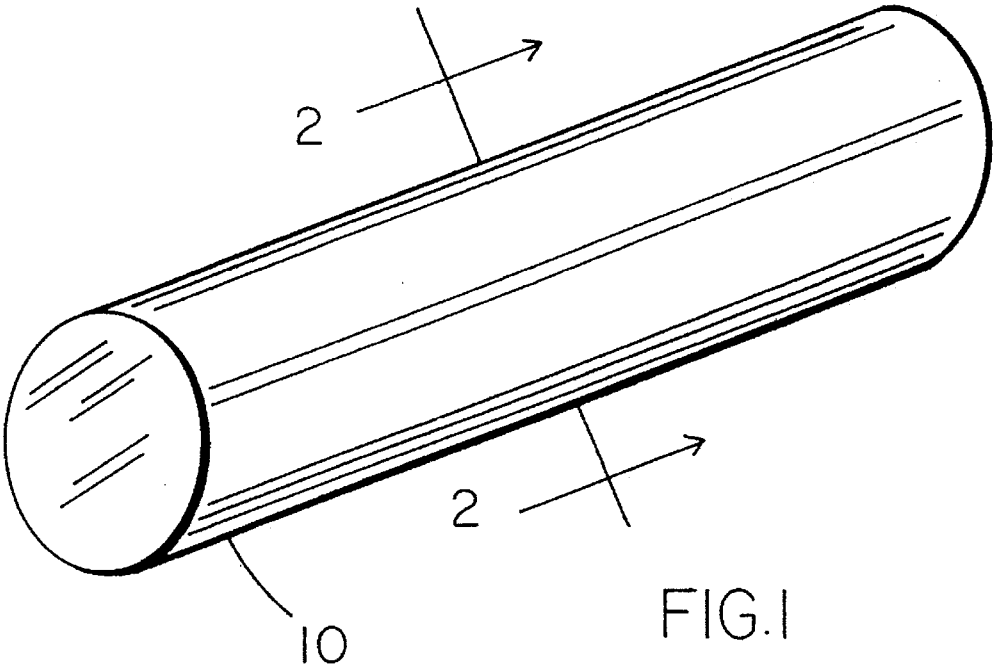
FIG. 1 is a perspective view of a grain formed according to a process in accordance with the present invention.

Referring to FIG. 1, a propellant grain 10, referred to herein simply as a grain, is a unitary element formed by casting from a propellant mixture in accordance with the present invention. It may, for example, comprise a combustible mixture of ammonium perchlorate, polymer resin and carbon. Grain 10 is shown as being of cylindrical configuration.

Figure 2A:
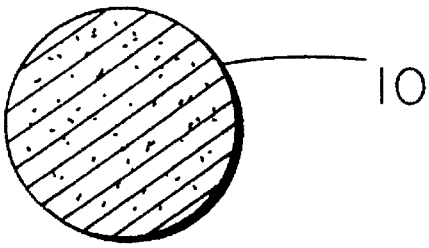
FIG. 2A is a cross-section taken along line 2—2 of FIG. 1.

FIG. 2A shows in cross-section the solid character of grain 10.

Figure 2B:
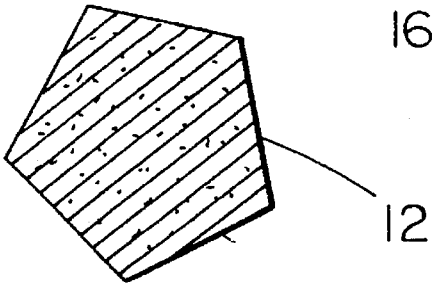
FIGS. 2B and 2C are similar cross-sections representative illustrating different grain embodiments.
Figure 2C:
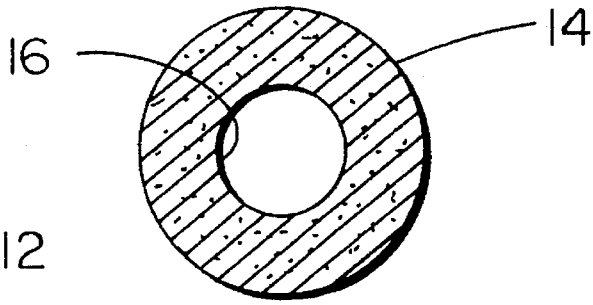
Figure 3:
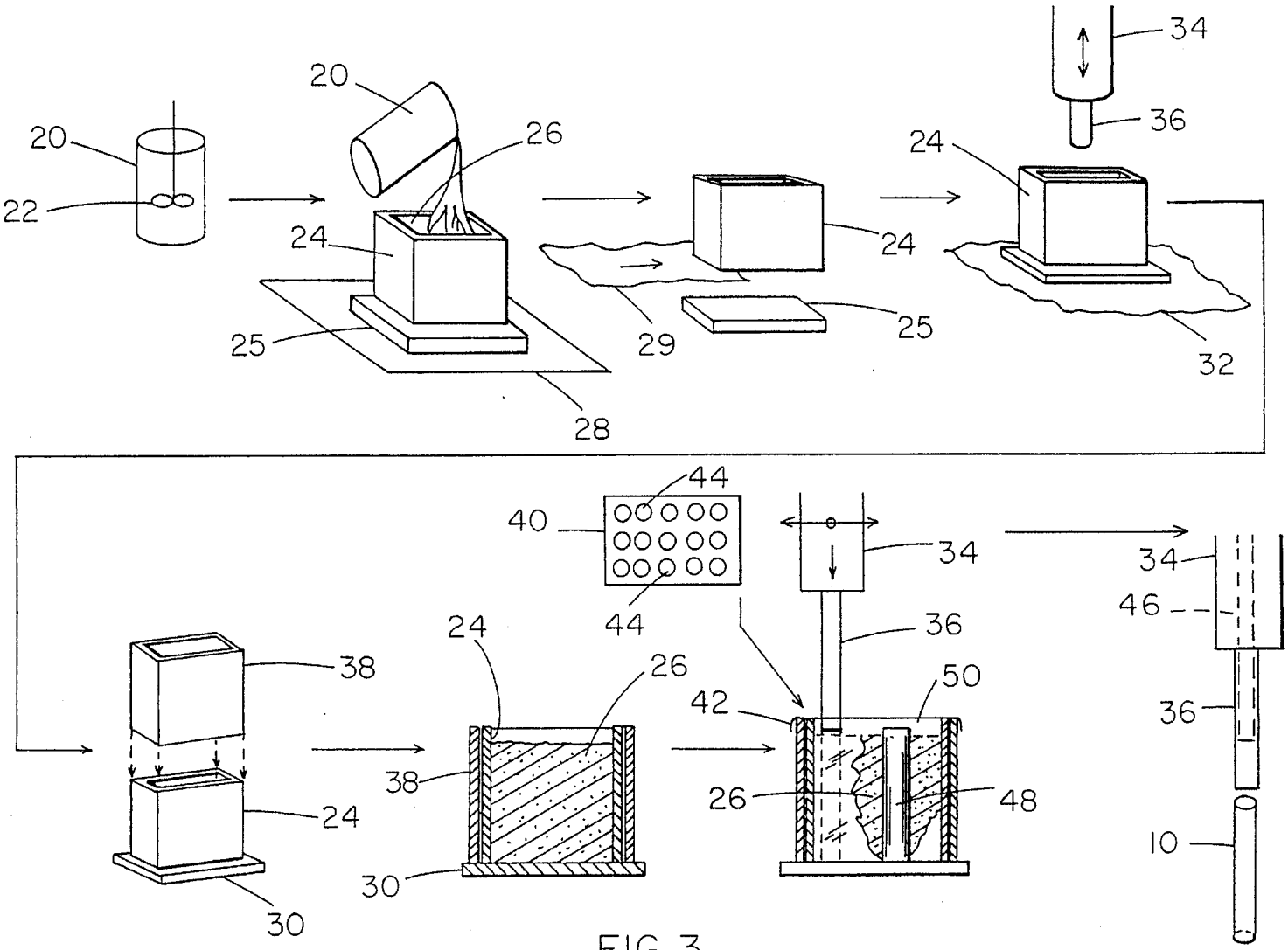
FIG. 3 is process layout illustrating steps in a process in accordance with the present invention.

Although its cross-section is accordingly uniform along its length and circular, numerous other configurations are possible. FIG. 2B shows as an example a polygonal-section grain 12, and FIG. 2B depicts an apertured grain 14 having a central bore 16.

Other cross-sections for grains produced according to the invention such as rectangular, otherwise polygonal, fluted, star-like, scalloped and so forth, without limitation.

Grains of various lengths may be produced by the new methodology, preferably of uniform cross-section over at least the major portion, in the entirety, of the overall length.

Aspect ratios, being the ratio of the length divided by the nominal diameter, may vary according to a desired use of the propellant grains, from unity (1:1) to substantially greater than 10:1.

The precise dimensions of such elongate grain are not critical, and grain 10, for example, may be several inches in length, uniform in diameter, and having a representative or typical aspect ratio of about 10:1, by way of general example, and thus substantially elongate, but in any event dimensionally defined according to its desired usage and product specifications for an intended purpose. Even so, it is to be understood that a grain produced in accordance with the present methodology may be very precisely dimensioned. An exemplary cylindrical grain dimension is about 12 in. (30.5 cm) in length and having diameter of 1–2 in. (2.5–5.1 cm) .

Although grains such as those designated 10, 12 and 14 may be formed of a granular material, such a grain is a macrostructure of monolithic character and substantially uniform in cross-section along its length.

The present process for grain manufacture is capable of batch formation of solid or cored unitary grains of propellant or other ignitable material of generally uniform cross-section with myriad possible grain geometries and surface topologies.

Generally, the process includes preparing a known combustible e.g., a propellant, mixture, such as ammonium perchlorate, polymer resin and carbon, by known mixing technique, using a commercial mixer container 20 using an impeller 22 including heating the mixture to a predetermined temperature within a specified possible temperature range, such as broadly about 130° F. to about 150° F. The mixture is then poured at, a temperature of 130°–135° F., for example. into a topless mold 24 of selected configuration and having a non-stick surface, wherein the mixture so poured, i.e., casted, is allowed to cure for a predetermined period of time.

The mold has a removable bottom 25 and may preferably be of material such as polyurethane of a thickness of about 1 in. (2.54 cm), which is not only reusable but from which the material can readily be removed for a new batch production cycle. Other mold materials may be polypropylene or polytetraflouroethylene ("Teflon")-coated steel, as will inherently sticky, viscous, and tenacious nature of propellent compositions of this resinous type.

To assist in minimizing the number of interfaces, discontinuities or voids which could be otherwise formed, the mold preferably but not necessarily is placed on a vibrating apparatus during filling (casting) and/or curing. Manual shaking may suffice but more thorough mechanical shaking viz., by a the use of vibrator table or shaker 28, is preferred.

Once the cast block of propellant composition is cured, the bottom 25 of the mold is removed and the mold containing the cured mixture may be placed on a thin sheet of soft nonreactive material 29. The cured mixture is now a cast block 26 of semirigid and yet plasticly deformable propellant material from which grains are to be cut.

Mold 24 is then transferred to a support surface 30 which may advantageously be wood chipboard and may be located upon the bed or frame 32 of a hydraulic press having a press ram 34.

A walled support apparatus in the form of a rectangular metal frame 38 may be placed over the exterior of mold 24 containing the cured block of mixture to prevent the walls of the mold, and thus also, the block, from flexing during subsequent cutting steps of process. The mold containing the block of cured mixture 26, the thin sheet of soft material (if used), and the walled support 38, are now positioned for cutting sequence by hydraulic press 34. The press ram is equipped with one or more thin-walled cutting dies, such as that single cutter shown at 36, each defining intended grain geometry with preselected surface topology. When lowered by press ram 34 into the cured mixture each such thin-walled cutting die 36 is capable of cutting a single grain at a time, so that if multiple cutting dies are used, a plurality of grains are cut at a time. Metal cutting dies are preferred for their thin-walled character, but other cutters or cutting die materials may be used. Because the thin-walled cutting die or dies are of grain-defining configuration, when removed from the cured mixture, each such cutter produces a cut grain of the cross-section defined by the cutting die.

According to a most precise mode of the process, descent stroke of press ram 34 downwardly forces a single tubular cutting die 36 into block 24 by uniform vertical cutting movement until a distal cutting edge of the cutting die comes into contact with support surface 30. The cutting die is then smoothly retracted by corresponding uniform vertical lifting of the press ram.

For carefully controlling the positioning of cutting die 36 for a series of grain-cutting sequences, it may be preferable to use a cutting guide 40 having a shape corresponding to the plan of the mold 24 and its strengthening frame 38, which such guide 40 may engage for precisely reliable prelocation by means of a peripheral flange 42 of the guide. Guide 40 is prepunched with a preestablished pattern of guide apertures 44 which allow rapid alignment of press ram 34 which may be shifted in x- and y-axes in the horizontal plane (as by manual or machine-implemented positioning). The pattern of guide apertures 44 may be a matrix chosen by trial-and-error as that which will give a maximum yield without unacceptable degree of grain quality degradation.

As cutting die 36 ascends after cutting action, it removes and retains a cut grain within the die. By repositioning the press ram in the x- and y-plane to a suitable position, the pulled grain is then ejected from the cutter, as by use of a suitable ejector pin 46 mechanism. The ejected grain is then transferred for further processing such as quality control inspection and other steps which are beyond the present disclosure.

As each grain is withdrawn by ascending ram movement, the press or other auxiliary means may then be used to place a plug, viz., a dowel 48 of wood, polyurethane or other suitably inert, non-reactive material, within the resultant die-cut bore 50, namely a grain-removal void, remaining after the grain is withdrawn from block 26, with the dowel having dimensions closely conforming to the bore. With such dowel 48 in place to maintain the dimensional stability of block 26, which might otherwise deform during cutting of adjacent grains, especially as such cutting occurs in close proximity to a bore from previous cutting, the cutting die is then reset by repositioning under automated machine-control or by nonautomated or manual technique, for a subsequent grain-cutting operation of the cutting die is then carried out. Each grain cutting step followed in succession by dowel placement in a bore resulting from grain extraction, and subsequent repositioning of the cutting die. Such steps are repeated until a sufficient number of grains as reliably may be realized, are cut from the block. The dowels may remain in place to replace the die-cut grains until all grains permitted by guide 44 have been die-cut.

Accordingly, the cutting steps of the process involve (1) positioning the cutting die to a location relative to the cast block from which a grain of material may be cut; then (2) forcing at least one cutting die into the cast block to cut therefrom a grain of material of the cast block; then (3) extracting the cut grain of material of the cast block therefrom for further use; and repeating steps (1) through (3) until the cast block has yielded a satisfactory number of grains. Such yield will have been predetermined by guide 40 and/or by practical empirical data indicating proximity of successive kits according to the constraint that grain cuts should not be carried out in such proximity that a prior cutting and extraction of a cut grain will not adversely effect the quality of a grain to be further cut and extracted. Thus, it will be found that grain extractions in too close a proximity, on the one hand, will adversely effect yield when extracted grains do not attain a quality control standard or specification. On the other hand, if grains are cut and extracted with too great a spacing, material of the cured block will be wasted. In such manner, an optimum grain cutting spacing such be established by empirical data, and the process accordingly further preferably comprises determining a preselected grain spacing for cutting of grains from the cured block by empirically determining a grain proximity which will not adversely effect grain yield but will not provide unacceptable waste of material of the cured block. Thus, it is preferred to cuts the grains as closely as is practical. The grain spacing may be reduced, and the yield increased accordingly, by inserting dowels in the manner described as each grain is extracted. The number of grains which may be cut from the block of each batch varies according to the size of mold used to form the block, and thus yield will be dependent as well upon grain dimensions. The mold may be so sized as to permit many grains to be cut or to permit a single grain to be cut therefrom.

Thus, a unitary propellant grain made from a cured, cast block of semirigid yet plasticly deformable propellant material, by positioning a cutting die to a location relative to the cast block from which a grain of material may be cut, forcing the cutting die into the block to cut the grain therefrom, and extracting the cut grain from the block.

A propellant grain produced by such process is of unexpectedly high quality.

The following example illustrates the process:

EXAMPLE

A propellant mixture is formed by mixing 85% w/w ammonium perchlorate, 12% w/w polymer resin and 3% w/w carbon by use of a commercial mixer at temperatures of 140°–150° F. The mixture is then poured at a temperature of 130°–135° F. into a topless polyurethane mold of rectangular configuration and about 1 in. (2.5 cm) wall thickness. The mold bottom is removable. A vibrating table is used as a shaker to settle the poured composition during pouring or shortly thereafter so as to avoid gas bubbles or other voids. The mixture is then allowed to cure in the mold for 72 hours. The bottom of the mold is removed after the curing. The mold containing the cured block is placed on a chipboard under a hydraulic press ram. A metal support is placed around the exterior of the mold to prevent the walls of the mold the cured composition block from flexing during grain cutting steps. The hydraulic press ram carries a single tubular metal cutting die of preferred geometry, and of preferred interior diameter in the range from about 1 to about 2 in. The press is used to die cut a single grain at a time. As each grain is thus die cut and removed by the cutter, the resultant die bore is filled with a dowel.

The so-produced grains are subjected to x-ray and other quality control analysis and are found to be void-free. Microscopic analysis after cross-sectioning reveals no interfaces or discontinuities or dislocations of unsatisfactory character. The grains are uniform and require no lathe-turning and may be used for intended purpose with high yield.

In view of the foregoing, it will be seen that the several objects of the invention are achieved and other advantages are attained.

Although the foregoing includes a description of the best mode contemplated for carrying out the invention, various modifications are contemplated. For example, although the foregoing example illustrates a process for die cutting of solid grains, other arrangements are possible for providing apertured grains. Thus, for example, concentric cutting dies may be used so that a core is produced with each grain.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. Process for the production of a batch of unitary grains of propellant or other ignitable material, comprising (a) preparing a constituent mixture of the material by mixing constituents of the material while heating the mixture to at least a predetermined pouring temperature within a permissible temperature range;

(b) pouring the constituent mixture into a mold of selected configuration;

(c) curing the constituent mixture for a predetermined period of time resulting in a cured, cast block of semirigid yet plasticly deformable material;

(d) positioning the cutting die to a location relative to the cast block from which a grain of material may be cut;

(e) forcing the cutting die into the cast block to cut therefrom a grain of material of the cast block; then (f) extracting the grain of material of the cast block therefrom for further use thereby leaving a void where the grain is extracted;

(g) inserting stabilizing means within the void for maintaining dimensional stability of the plasticly deformable material during further cutting of grains from the block; and (h) repeating steps (d) through (g) until the cast block has yielded a satisfactory number of grains.

2. Process according to claim 1 further comprising vibrating the mold by placed it on a vibrating apparatus during either pouring or curing whereby to minimize or avoid interfaces and voids which may be formed in the material during pouring.

3. Process according to claim 1 wherein the step of curing is carried out by permitted the cast block to remain undisturbed in the mold for a predetermined curing interval.

4. Process according to claim 1 wherein steps (e) and (g) are carried by the use of the cutting die.

5. Process according to claim 1 wherein the mold has a removable bottom and, after the cast block is cured, the bottom of the mold is removed, for cutting of grains from the cast block.

6. Process according to claim 5 further comprising supporting remaining portion of the mold, namely its walls, after the bottom of the bold is removed, during cutting of grains from the cast block.

7. Process according to claim 6 wherein the supporting of remaining portion of the mold is carried out by surrounding the exterior of the walls of the mold by a support frame during cutting of grains from the cast block.

8. Process according to claim 1 wherein step (e) is carried out by using a tubular cutting die placed in die-cutting relation to the cast block, the cutting die defining intended grain geometry with preselected surface topology.

9. Process according to claim 8 wherein the cutting die is carried by the ram of a hydraulic press, and comprising operating the press through a die-cutting cycle in which the die is forced into the cured block and then retracted, such that when forced by the ram into the cured mixture, the die cutter cuts a single grain at a time and extracts it.

10. Process according to claim 9 wherein the ram is carries a plurality of thin-walled tubular cutting dies for cutting and extracting a corresponding plurality of grains, each thin-walled cutting die being of selected configuration such that, when removed from the cured mixture, it withdraws the cured block a grain of selected cross-section corresponding to that of the die.

11. Process according to claim 9 wherein the block is supported relation upon cutting block during cutting of grains.

12. Process according to claim 1 wherein the step of inserting stabilizing means within the void for maintaining dimensional stability of the plasticly deformable material during further cutting of grains from the block comprises placing a plug of inert material within a grain-removal void remaining after the grain is withdrawn from the cured block, the plug having dimensions closely conforming to the bore such that each so-inserted plug maintains the dimensional stability of the block for successive cutting steps.

13. Process according to claim 1 further comprises determining a preselected grain spacing for cutting of grains from the cured block by empirically determining a grain proximity which will not adversely effect grain yield but will not provide unacceptable waste of material of the cured block.

14. Process according to claim 13 wherein the preselected grain spacing is maintained during cutting of grains by the use of a guide placed in relation to the cured block.

15. A grain made by the process of claim 1.

* * * * *